US005149077A

United States Patent [19]

Martin et al.

[11] Patent Number: 5,149,077

[45] Date of Patent: Sep. 22, 1992

[54] HYBRID NUDGER ROLL

[75] Inventors: Michael J. Martin; Steven R. Moore; Russell J. Sokac, all of Rochester; Robert P. Siegel, Penfield; Gerald M. Garavuso, Farmington, all of N.Y.

[73] Assignee: Xerox Corporation, Stamford, Conn.

[21] Appl. No.: 719,854

[22] Filed: Jun. 24, 1991

[51] Int. Cl.[5] ..... B65H 3/22

[52] U.S. Cl. ..... 271/18.3; 271/119

[58] Field of Search ..... 271/18.3, 109, 119, 271/120

[56] References Cited

U.S. PATENT DOCUMENTS 3,866,903 2/1975 Eppe et al. ..... 271/119
4,157,825 6/1979 Ellenberger et al. ..... 271/10
4,928,948 5/1990 Evangelista et al. ..... 271/110

FOREIGN PATENT DOCUMENTS 69626 6/1977 Japan ..... 271/109
57447 3/1988 Japan ..... 271/119

*Primary Examiner*—Robert P. Olszewski
*Assistant Examiner*—Steven M. Reiss
*Attorney, Agent, or Firm*—William A. Henry, II

[57] ABSTRACT

A hydrid nudger roll for use in a friction retard feeder includes alternating elastomeric and studded rolls positioned on a support shaft. The outer surface of the elastomeric rolls extends beyond the tips of the studded rolls, but when the elastomeric rolls are deformed against a stack of sheets due to normal force, the tips of the studded rolls extends beyond the outer surface of the elastomeric rolls.

6 Claims, 3 Drawing Sheets

HYBRID NUDGER ROLL

This invention is directed generally to friction retard feeders, and more particularly, to an improved nudger for use in such feeders.

Traditionally, nudger rolls are employed in friction retard feeders to move the top substrate(s) from a stack to a retard mechanism as a result of a net frictional force. The retard mechanism allows a single substrate at a time to pass through the mechanism. Some nudger rolls are constructed from an elastomeric material. These rolls have a failure mode of loss of a suitably high friction coefficient due to contamination, dirt build-up and wear. Other nudger rolls are in the form of a series of metal pin wheels which act to grab or stick the top sheet in the stack and move it into the friction retard mechanism. A studded roll of this type works well for most substrate types, and has a long roll life. However, the studded roll does not handle high density substrates very well due to an inability to penetrate the substrate surface. Also, the studded roll does not handle transparencies satisfactorily. Further, the studded roll may leave scratch marks on the surface of substrates fed at high feed rates.

Attempts at overcoming these nudge roll deficiencies include U.S. Pat. No. 3,866,903 which discloses a sheet feeding apparatus that delivers a top sheet of a stack to advancing rolls by using a cylindrical sleeve comprised of an elastomeric material with a high coefficient of friction. The sleeve is rotated by a drive to move the top sheet towards the advancing rolls. A device for separating single textile workpieces from the top of a stack is shown in U.S. Pat. No. 4,157,825 that includes a holding member having holding pins and a rotatable member having a plurality of radially extending bristles. The holding member causes an engagement of the topmost workpiece with the pins. The rotatable member directs the topmost workpiece. A pair of nudger rolls are disclosed in U.S. Pat. No. 4,928,948 for urging a sheet toward feed rolls that are on the same centerline in the feed direction. Even with availability of the above-mentioned nudger rolls, the need still exists for a nudger roll useful in retard feeders for shingling a wide variety of substrates.

Accordingly, in an aspect of this invention, a hybrid nudger roll is disclosed which comprises an elastomeric covering over a studded roll. The studded roll has teeth just beneath the surface of the elastomeric roll that are adapted such that when the elastomeric roll deforms as force is applied to it, the teeth of the studded roll are exposed.

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
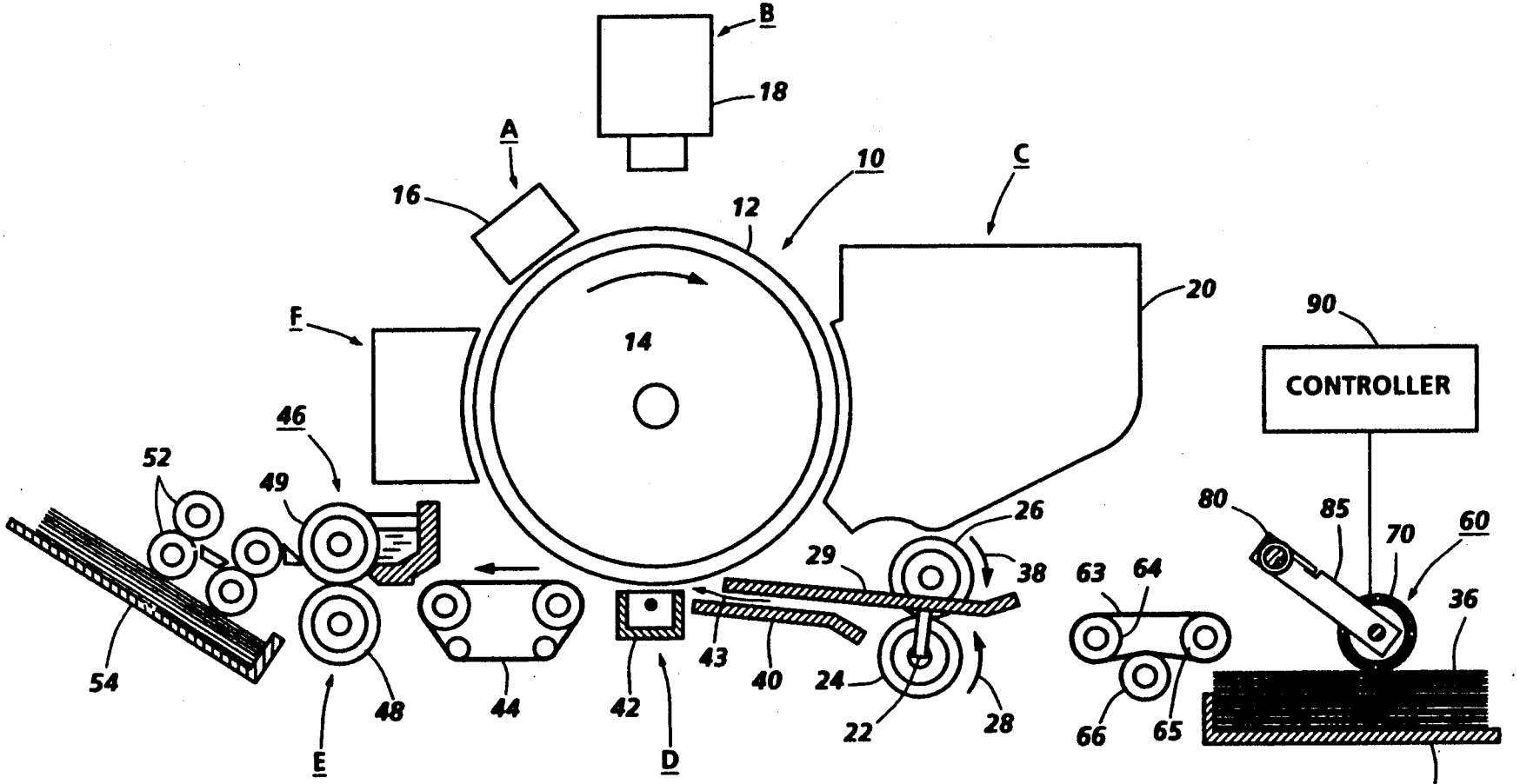
FIG. 1 is a schematic elevational view of an electrophotographic printing machine incorporating the features of one aspect of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in this application to the particular embodiment shown herein. For example, the apparatus of the present invention will be described hereinafter with reference to feeding successive copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by retard sheet feeding apparatus 60 to transfer station D. Nudger roll 70 of sheet feeding apparatus 60 advances one or more copy sheets to a retard nip formed at the unsupported section of belt 63 which is supported for rotation by drive roll 64 and idler roll 65 and retard roll 66. Retard roll 66 applies a retarding force to shear any multiple sheets from the sheet being fed and forwards it to registration roller 24 and idler roller 26. Registration roller 24 is driven by a motor (now shown) in the direction of arrow 28 and idler roller 26 rotates in the direction of arrow 38 since roller 24 is in contact therewith. In operation, feed device 60 operates to advance the uppermost sheet from stack 36 into registration rollers 24 and 26 and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed form photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the top feeder system in greater detail.

Figure 2:
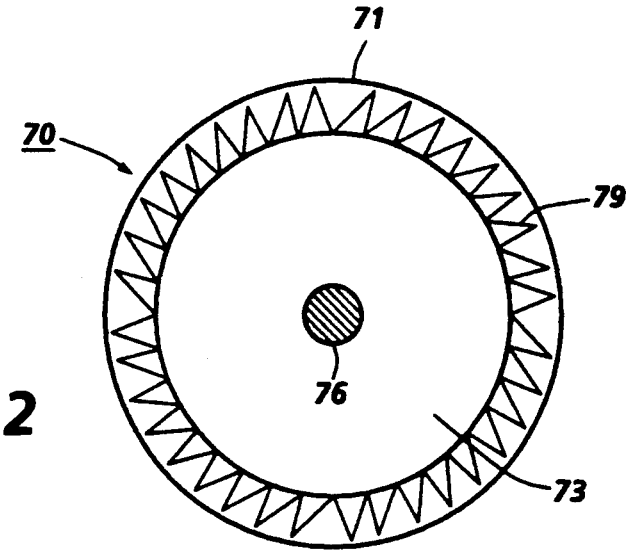
FIG. 2 is an enlarged partial side view of the hybrid nudger roll shown in FIG. 1.
Figure 3:
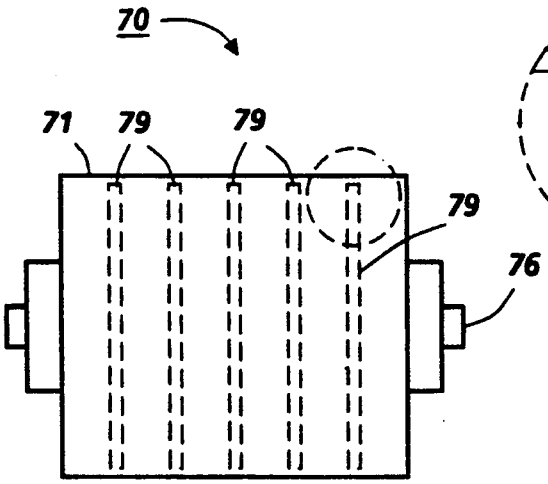
FIG. 3 is an enlarged plan view of the hybrid nudger roll employed in the feeder of FIG. 1.
Figure 3A:
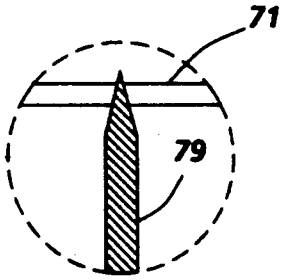
FIG. 3A is an enlarged side view of a portion of the hybrid nudger roll of FIG. 3 showing a tooth of a studded roll extending beyond the outer surface of nudger roll.

Referring now to FIGS. 2, 3 and 3A, the detailed structure and operation of the hybrid nudger roll will be described where retard feeder 60 includes a nudger roll 70 positioned above sheets 37 stacked on platform 61 that has a sheet retaining wall 62 attached thereto. Nudger roll 70 comprises a studded roll 72 in FIG. 2 covered by a single piece suitable elastomeric material, such as, LIM silicone TM 71 with both being mounted on core 73 and held on the core by stopper 75 as shown in FIG. 4A. The core 73 and one-way clutch 74 are mounted for rotation on a support shaft 76 by a suitable motor (not shown). As seen in the preferable embodiment of FIGS. 2 and 3, the metal studs 79 of the wheel 72 are located just below the surface of the nudger roll. When force is applied to the nudger roll surface, the elastomer material 71 will deform and thereby expose the tip of studs 79. Using this type of hybrid nudger roll enhances the feeding of high density substrates or sheets and transparencies (failure modes of the studded nudger roll) by relying primarily on the elastomeric characteristics of the hybrid roll. Similarly, misfeeds with light and normal weight sheets are reduced by relying on the studded characteristics of the hybrid roll.

Hybrid roll 70 is biased against sheet stack 36 by way of a conventional torsion spring 80 through arm 85 which is in engagement with nudger roll shaft 76. With nudger roll 70 being biased against the sheet stack in this manner, studded wheel 72 will not extend beyond the outer surface of elastomeric roll 71 if the coefficient of friction between the roll and the top sheet in the stack is greater than the coefficient of friction between the top sheet in the stack and the remainder of the stack. However, if the coefficient of friction between the nudger roll and the top sheet in the stack is less than the coefficient of friction between the top sheet in the stack and the remainder of the stack, torsion spring 80 through arm 85 will cause the nudger roll to press harder against the stack and thereby deforming the elastomeric roll and causing studs 79 to extend beyond the surface of the elastomeric roll as shown in FIG. 3A. The studs will penetrate the surface of the top sheet in the stack and break the bond between that sheet and the rest of the stack. Once this bond is broken, the force of the torsion spring is automatically lessened and as a result, the elastomeric roll assumes its original shape and covers the tips of studs 79.

Figure 4:
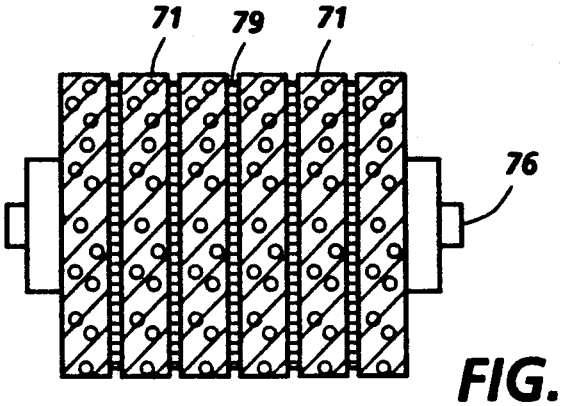
FIG. 4 is an enlarged plan view of an alternative hybrid nudger roll embodiment employing separate interspersed studded and elastomeric rolls.
Figure 4A:
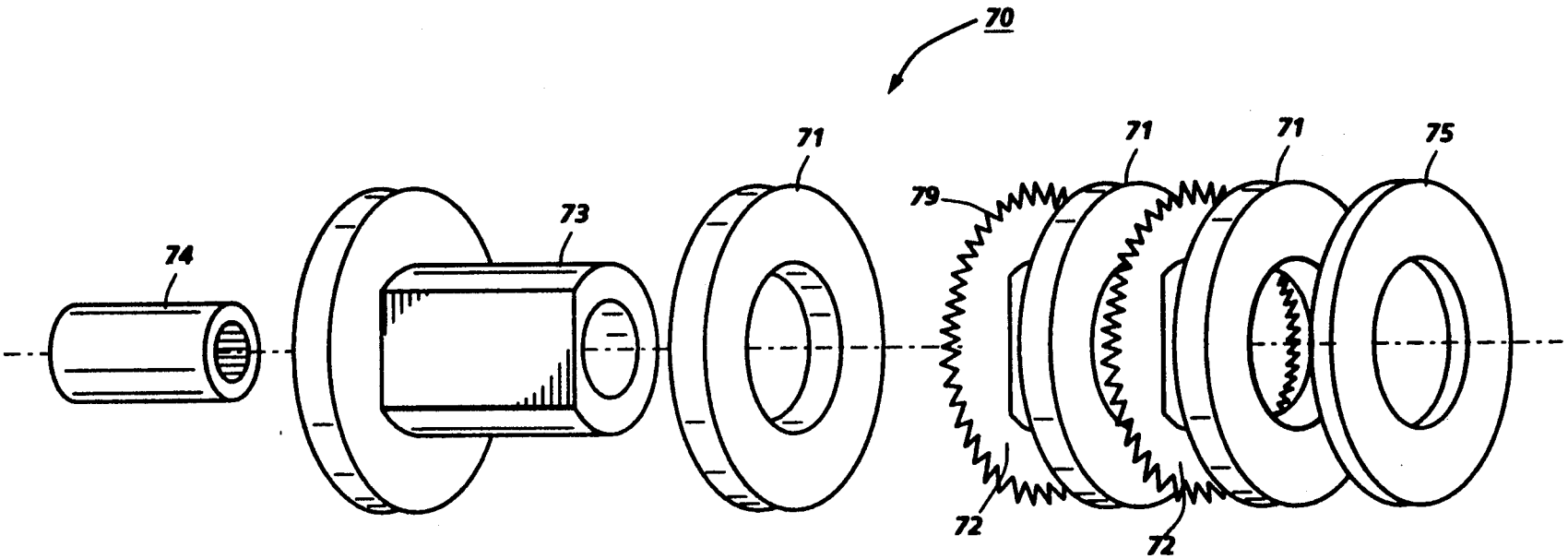
FIG. 4A is an exploded isometric view of the hybrid nudger roll of FIG. 4 employable in the printing system shown schematically in FIG. 1.

An alternative embodiment of a nudger roll in accordance with the present invention is shown in FIGS. 4 and 4A as comprising studded wheels 72 interspersed between elastomeric rolls 71 with both sets of rolls being mounted on a core 73. The primary difference between this nudger roll and the one in FIG. 3 is that the elastomeric material does not cover the studded wheels. The operation of the feeder with the nudger roll is the same as with the nudger roll in FIG. 2 except that studs 79 do not have to extend through the elastomeric material to reach the top of the sheet stack.

In conclusion, a hybrid nudger roll for a friction retard feeder is disclosed which combines the benefits of an elastomeric nudger roll and a studded nudger roll. As configured, the hybrid nudger roll elastomeric rolls and studded rolls are mounted on a common shaft with the studded rolls being removed from a plane along the surface of the elastomeric rolls. The elastomeric material deforms when force is applied exposing the tips of the studded rolls, thereby enhancing the feeding of light and heavy weight sheets at high speeds, ads well as, transparencies.

It is, therefore, evident that there has been provided in accordance with the present invention a hybrid nudger roll for use in a friction retard feeder which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A nudger roll for use in a friction retard feeder for feeding substrates from a stack to a retard mechanism, comprising:

a core member;

a plurality elastomeric members supported by said core member; and a plurality of studded members supported by said core member, and wherein said plurality of studded members are positioned on said core member alternately with respect to positioning of said plurality of elastomeric members, and wherein tips of said plurality of studded members are just below a plane along the surface of said plurality of elastomeric members.

2. The nudger roll of claim 1, including a torsion spring for applying normal force to said elastomeric member against the stack of substrates.

3. A nudger roll for use in a friction retard feeder for feeding substrates from a stack to a retard mechanism, comprising:

a core member;

a plurality of studded members supported by said core member;

a single piece of elastomeric material covering said studded members; and means for applying a normal force to said elastomeric member and press it against the sheet stack in order to deform said elastomeric material and expose studs of said studded member when the coefficient of friction between said elastomeric material and the sheets in the stack is less than a predetermined value.

4. The nudger roll of claim 3, wherein said means for applying a normal force to said elastomeric material is a torsion spring.

5. In a reproduction system adapted to make copies of page image information by transferring the page image information to copy sheets fed from a copy sheet feeder, the improvement in the copy sheet feeder characterized by:

a core member;

a plurality of studded members supported by said core member;

a single piece of elastomeric material covering said studded members; and means for applying a normal force to said elastomeric member and press it against the sheet stack in order to deform said elastomeric material and expose studs of said plurality of studded members when the coefficient of friction between said elastomeric material and the sheets in the stack is less than a predetermined value.

6. A friction retard feeder for feeding substrates from a stack to a retard mechanism, comprising:

a nudger roll including a core member;

a plurality elastomeric members supported by said core member;

a plurality of studded members supported by said core member, and wherein said plurality of studded members are positioned on said core member alternately with respect to positioning of said plurality of elastomeric members, and wherein tips of said plurality of studded members are just below a plane along the surface of said plurality of elastomeric members; and means for applying a normal force to said elastomeric member and press it against the sheet stack in order to deform said elastomeric material and expose studs of said plurality of studded members when the coefficient of friction between said elastomeric material and the sheets in the stack is less than a predetermined value.

* * * * *